US012622478B1

(12) United States Patent
Bui et al.

(10) Patent No.: US 12,622,478 B1
(45) Date of Patent: May 12, 2026

(54) ADAPTER SYSTEM FOR USE WITH A SURGICAL HELMET ASSEMBLY AND A SURGICAL HOOD AND METHODS OF MAKING AND USING SAME

(71) Applicants: Phong Duy Bui, San Diego, CA (US); Sara McAfee, San Diego, CA (US)

(72) Inventors: Phong Duy Bui, San Diego, CA (US); Sara McAfee, San Diego, CA (US)

( * ) Notice: Subject to any disclaimer, the term of this patent is extended or adjusted under 35 U.S.C. 154(b) by 0 days.

(21) Appl. No.: 18/991,882

(22) Filed: Dec. 23, 2024

(51) Int. Cl.
*A42B 3/04* (2006.01)
*A41D 13/11* (2006.01)

(52) U.S. Cl.
CPC ..... *A42B 3/0406* (2013.01); *A41D 13/1153* (2013.01)

(58) Field of Classification Search
CPC ... A42B 3/0406; A62B 18/082; A62B 18/084; A62B 17/04; A41D 13/1153
See application file for complete search history.

(56) References Cited

U.S. PATENT DOCUMENTS

| | | | | |
|---|---|---|---|---|
| 10,750,800 | B2 * | 8/2020 | Jefferis | A41D 13/1153 |
| 2025/0000182 | A1 * | 1/2025 | Anderson | A41D 13/002 |
| 2025/0160453 | A1 * | 5/2025 | McBride | A41D 13/1184 |

* cited by examiner

*Primary Examiner* — Katherine M Moran
(74) *Attorney, Agent, or Firm* — James R. McDaniel

(57) ABSTRACT

A system and method for adapter system for use with a surgical helmet assembly and personal protective equipment (PPE) having a surgical hood, including; a personnel protective equipment having a surgical hood, wherein the surgical hood includes a faceplate operatively connected to the surgical hood, wherein the faceplate includes a first fastener located along an upper portion of the faceplate and a plurality of second fasteners located along a bottom portion of the faceplate, a surgical helmet assembly, wherein the surgical helmet assembly is configured to support the surgical hood, and wherein the surgical helmet assembly includes a helmet frame, and an adapter assembly operatively connected to the helmet frame, wherein the adapter assembly is configured to allow the faceplate of the surgical hood to be removably connected to the surgical helmet assembly, and to allow for an alignment of the faceplate and the surgical hood with the helmet frame.

17 Claims, 8 Drawing Sheets

ADAPTER SYSTEM FOR USE WITH A SURGICAL HELMET ASSEMBLY AND A SURGICAL HOOD AND METHODS OF MAKING AND USING SAME

FIELD OF THE INVENTION

The present invention is generally related to an adapter system for use with a surgical helmet assembly and personal protective equipment (PPE) having a surgical hood. The system includes two (2) side adapters and a center adapter that can be removably retained on a surgical helmet assembly frame. The adapter system is configured to allow a faceplate of a PPE having a surgical hood to be removably connected to the adapter system. In this manner, the surgical hood of the PPE can be removably retained on the surgical helmet assembly frame through the use of the adapter system.

BACKGROUND OF THE INVENTION

Prior to the present invention, as set forth in general terms above and more specifically below, it is known in the art of attaching surgical hoods to a surgical helmet that surgical helmets are primarily used in total joint replacement, including knees, hips, and shoulders to protect the healthcare personnel from direct contact with blood-borne pathogens, bone dust, fragments or the like. They may also be used for different types of medical procedures that produce a lot of bone or blood splatter.

It is also known that there are several different companies that manufacture surgical helmet and surgical hoods. Consequently, it can become problematic to attempt to removably attach the surgical helmet manufactured by company A to a surgical hood manufactured by company B. Therefore, it would be desirable to construct an adapter system for use with a surgical helmet and personal protective equipment (PPE), wherein the surgical helmet that can be attached to any surgical hood so that any third-party disposable, surgical hoods could be removably attached to any surgical helmets on the market. Further, it would be desirable to allow for the surgical facilities to potentially save money by using a less expensive alternative surgical hood while still using the same surgical helmet they have in the surgical facility.

It is a purpose of this invention to fulfill these and other needs in the systems and methods for removably attaching surgical hoods to surgical helmet assemblies in a manner more apparent to the skilled artisan once given the following disclosure.

The preferred system and method for removably attaching surgical hoods to surgical helmet assemblies, according to various embodiments of the present invention, offers the following advantages: ease of use; lightness in weight; portability; ability to quickly and easily removably attach any surgical hood to any surgical helmet assembly; easily attach or remove helmet adapter with no modifications to the helmet; ability to quickly and easily remove any surgical hood from a surgical helmet assembly; reduced cost; and the ability to securely attach the surgical hood to the surgical helmet assembly. In fact, in many of the preferred embodiments, these advantages are optimized to an extent that is considerably higher than heretofore achieved in prior, known systems and methods for removably attaching surgical hoods to surgical helmet assemblies.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

It is known in the art of attaching surgical hoods to a surgical helmet assembly that surgical helmet assemblies are primarily used in total joint replacement, including knees, hips, and shoulders to protect the healthcare personnel from direct contact with blood-borne pathogens, bone dust, fragments or the like. They may also be used for different types of medical procedures that produce a lot of bone or blood splatter.

It is also known that there are several different companies that manufacture surgical helmet and surgical hoods. Consequently, it can become problematic to attempt to removably attach the surgical helmet manufactured by company A to a surgical hood manufactured by company B. Therefore, it would be desirable to construct an adapter system for use with a surgical helmet and personal protective equipment (PPE), wherein the surgical helmet that can be attached to any surgical hood so that any third-party disposable, surgical hoods could be removably attached to any surgical helmet on the market. Further, it would be desirable to allow for the surgical facilities to potentially save money by using a less expensive alternative surgical hood while still using the same surgical helmet they have in the surgical facility.

Figure 10:
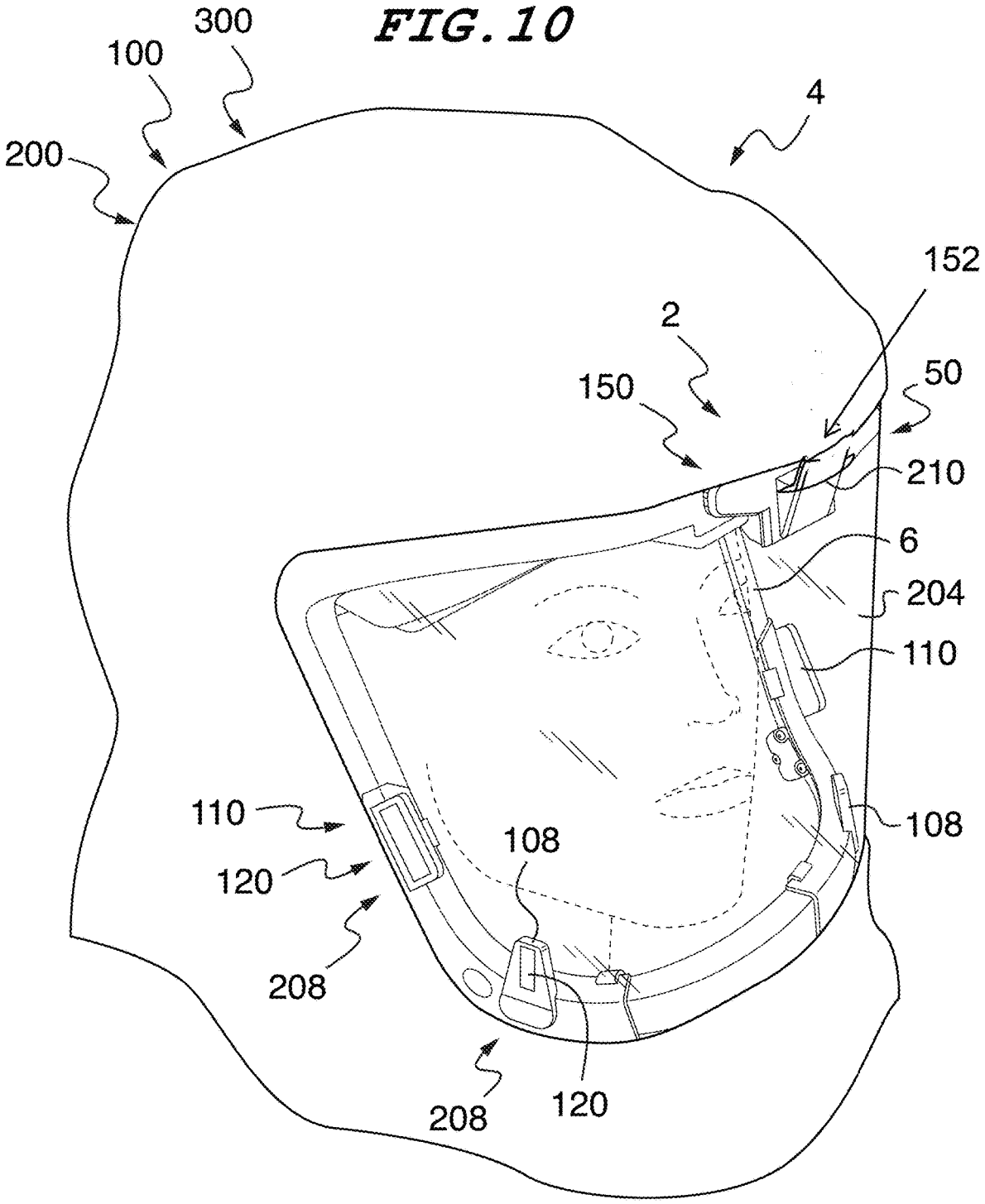
FIG. 10 is an isometric, side view of the adapter system being attached to the faceplate of the surgical hood and the surgical helmet assembly having the adapter system being worn by a user while the user is donning a personal protective equipment (PPE) having the hood, constructed according the present invention.

Reference is made now to FIGS. 1-5, where there is illustrated an adapter assembly 50 for use with a surgical helmet assembly 2 and a personal protective equipment (PPE) having a surgical hood 200 (FIG. 10). With respect to surgical helmet assembly 2, as shown in FIGS. 1-5, surgical helmet assembly 2, typically includes, in part, helmet 4, helmet frame 6, and center clip assembly 8. Preferably, surgical helmet assembly 2 is constructed of any suitable, durable, medical grade, UV resistant, heat resistant, lightweight, high strength polymeric material. As best shown in FIG. 10, the surgical helmet assembly 2 is worn by a medical personnel 300 under a surgical hood 200 such that the helmet 4 is located on the head of the medical personnel 300 and that the medical personnel 300 is able to look through the helmet frame 6 and the faceplate 204.

With respect to adapter assembly 50 for use with a surgical helmet assembly 2 and a personal protective equipment (PPE) having a surgical hood, in one embodiment, adapter assembly 50 includes, in part, side adapters 100 and center adapter 150. Preferably, adapter assembly 50 is constructed of any suitable, durable, medical grade, UV resistant, heat resistant, lightweight, high strength polymeric material. It is to be understood that while adapter assembly 50 is shown to include individual side adapters 100 and center adapter 150, adapter assembly 50 could be constructed as a one or more piece construction.

Figure 1:
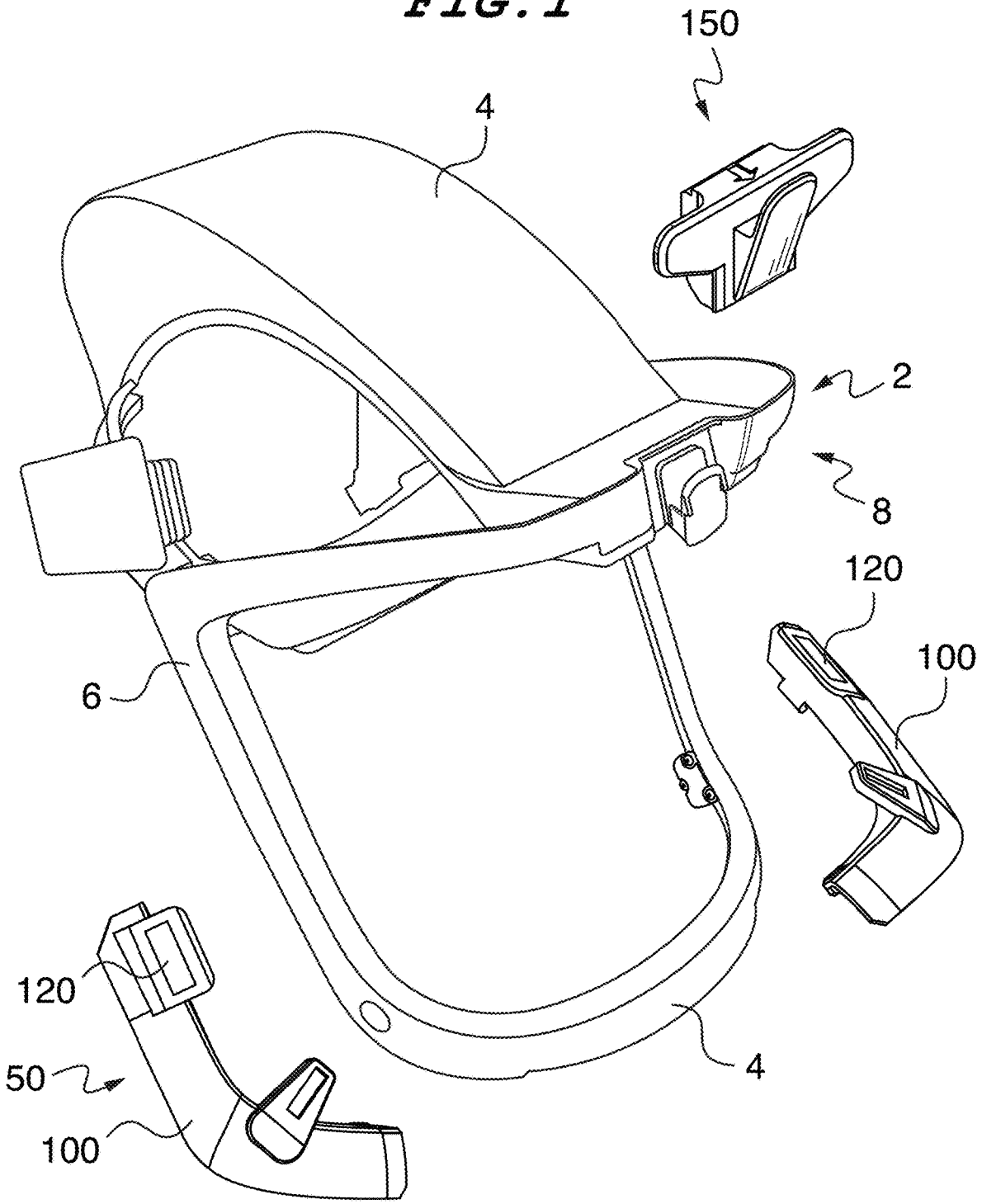
FIG. 1 is an isometric, top view of an adapter system for use with a surgical helmet assembly, constructed according the present invention.
Figure 2A:
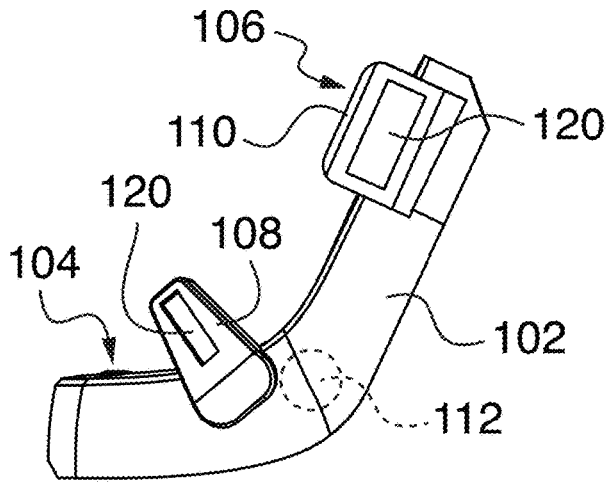
FIGS. 2A-2C are illustrations of a side adapter of the adapter system for use with a surgical helmet assembly, constructed according the present invention.
Figure 2B:
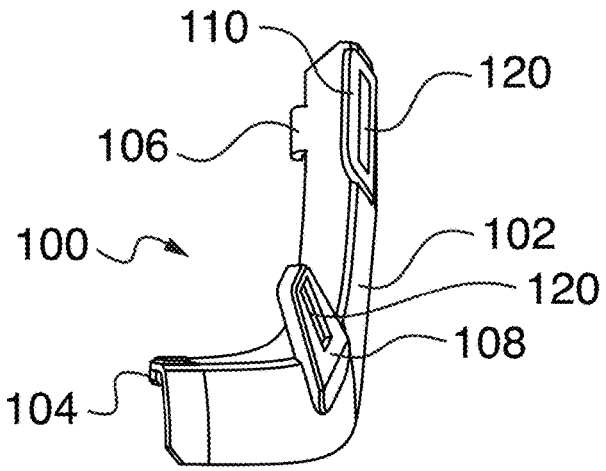
Figure 2C:
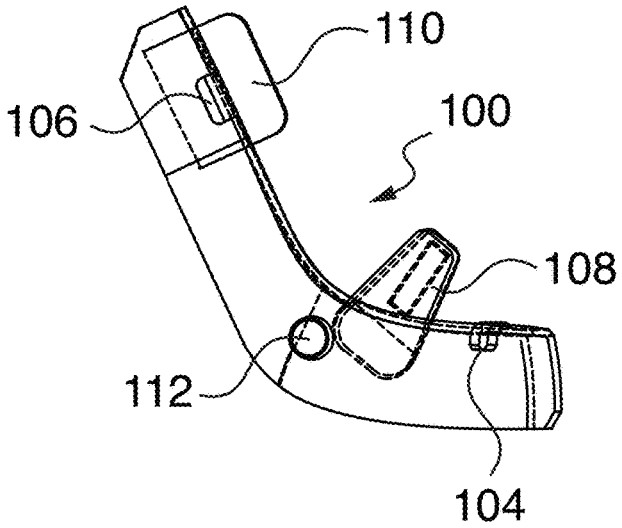

Regarding side adapters 100, as shown in FIGS. 2A-2C, in one embodiment, side adapters 100 include, in part, side adapter frame 102, clip 104, clip 106, extension 108, extension 110, and magnet 112. Preferably, side adapter frame 102, clip 104, clip 106, extension 108, and extension 110 are constructed by conventional techniques such as molding, forming, printing, casting, or the like. It is to be understood that side adapters 100 should be constructed in a single-piece construction.

With respect to center adapter 150, as shown in FIGS. 3A-3D, in one embodiment, center adapter 100 includes, in part, extension 152, extension base 154, center adapter frame 156, and center adapter clip assembly 158. Preferably, extension 152, extension base 154, center adapter frame 156, and center adapter clip assembly 158 are constructed by conventional techniques such as molding, forming, printing, casting, or the like. It is to be understood that center adapter 150 should be constructed in a single-piece construction.

Figure 3A:
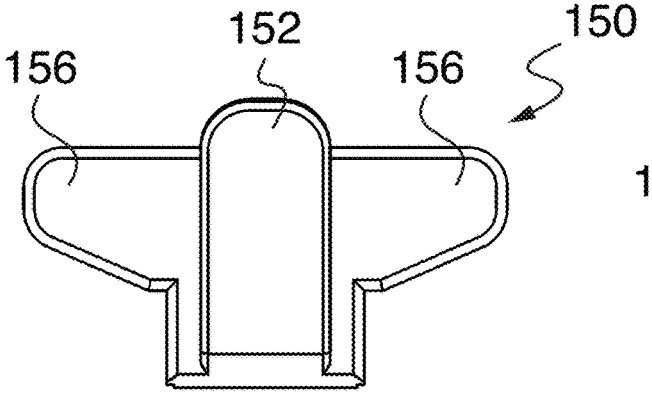
FIGS. 3A-3D are illustrations of a center adapter of the adapter system for use with a surgical helmet assembly, constructed according the present invention.
Figure 3B:
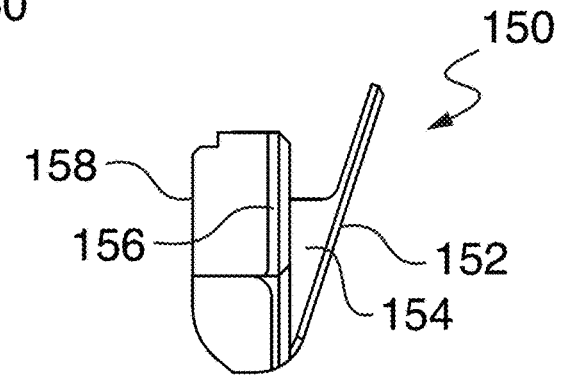
Figure 3C:
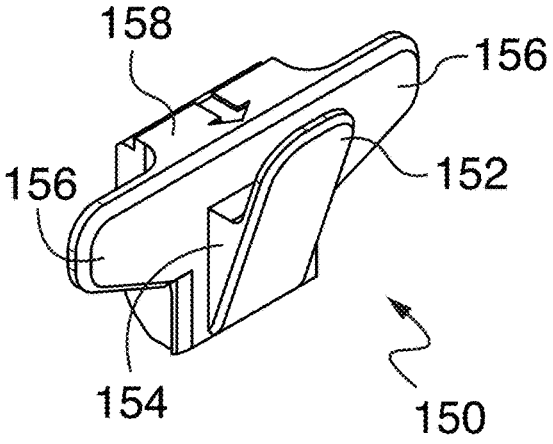
Figure 3D:
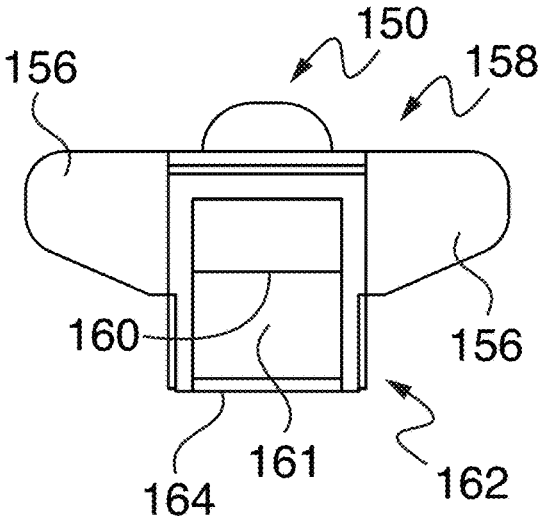

Regarding center clip assembly 158, as shown in FIG. 3D, center clip assembly 158 includes, in part, center clip 160, wall 161, opening 162, and wall 164. It is to be understood that the center clip 160, wall 161, and wall 164 form a well in which opening 162 is located and that wall 161 is connected to wall 164. As will be discussed in greater detail later, center clip assembly 158 is used in conjunction with center clip assembly 8 to releasably retain the center adapter 150 on the upper portion of the helmet frame 6.

Figure 4:
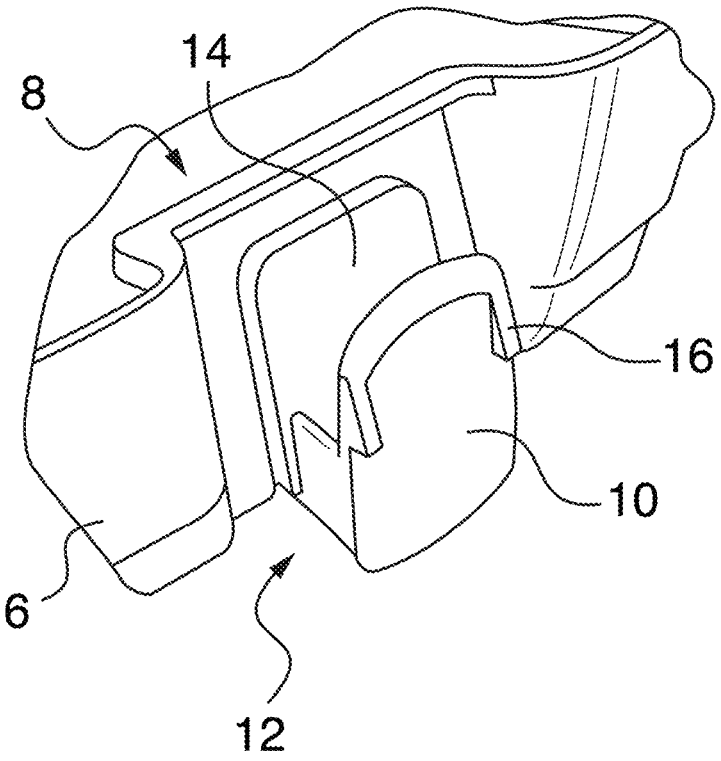
FIG. 4 (PRIOR ART)
FIG. 4 is an isometric, top view of the top of a surgical helmet assembly frame showing the surgical helmet assembly frame clip, according to the prior art.
Figure 5:
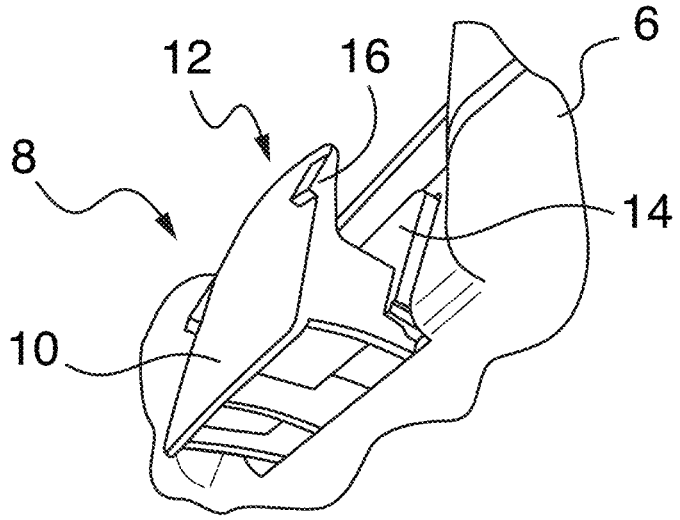
FIG. 5 (PRIOR ART)
FIG. 5 is an isometric, bottom view of the bottom of the surgical helmet assembly frame clip, according to the prior art.

With respect to center clip assembly 8, as shown in FIGS. 4 and 5, typically the center clip assembly 8 includes, in part, a clip arm 10, an opening 12, a clip arm base 14, and clip arm extensions 16. As is well known in the surgical helmet assembly art, center clip assembly 8 is constructed of any suitable, durable, medical grade, UV resistant, heat resistant, lightweight, high strength polymeric material. Also, as is well known in the art, the center clip assembly 8 is constructed by conventional techniques such as molding, forming, printing, casting, or the like.

Construction of the Adapter Assembly 50

Figure 7:
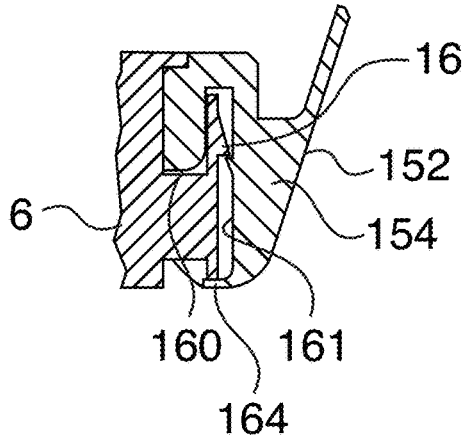
FIG. 7 is a cross-sectional view of the center adapter being attached to the surgical helmet assembly frame, taken along lines 7-7 in FIG. 6, constructed according the present invention.
Figure 6:
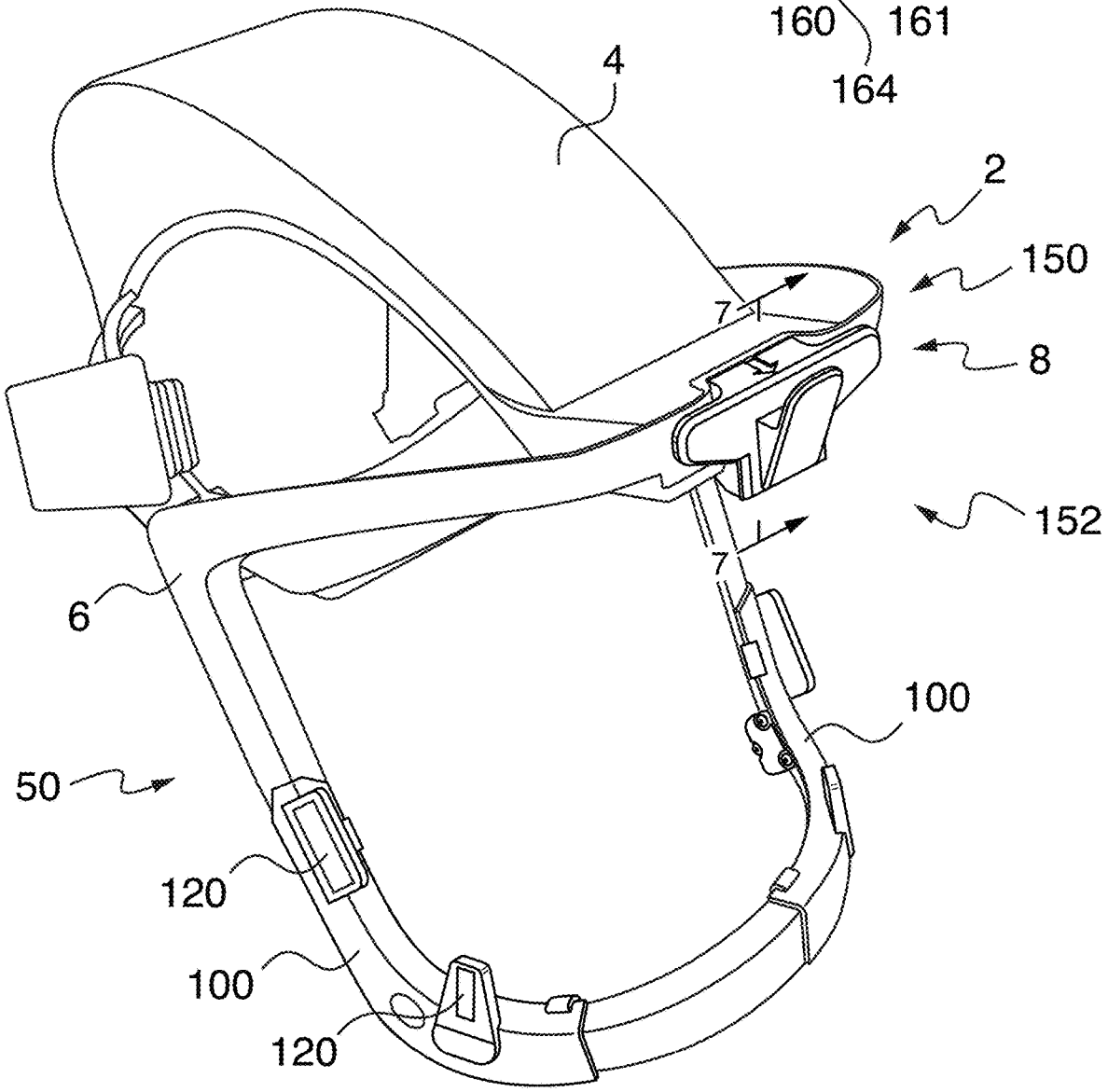
FIG. 6 is an isometric, top view of an adapter system for use with a surgical helmet assembly with the center adapter attached to the surgical helmet assembly frame, constructed according the present invention.

Regarding the construction of adapter assembly 50, attention is directed to FIGS. 6 and 7. As shown in FIG. 6, center adapter 150 has been releasably attached to center clip assembly 8. Also, center adapter 150 includes extension 152. As will be discussed in greater detail later, extension 152 can be used in conjunction with the opening 210 on the faceplate 204 (FIG. 10) to releasably attach the faceplate 204 of the surgical hood 200 to the center adapter 150. It is to be understood that fastener 208 could be located along other locations of the helmet frame 6 in order to securely retain the face plate 204 onto the helmet frame 6. Furthermore, it is to be understood that center adapter 150 and the upper portion of faceplate 204 are to be located under surgical hood 200 so that the sterility of the area around the medical personnel 300 can be maintained.

A unique aspect of the present invention is the attachment of the center clip assembly 158 to the center clip assembly 8. As shown in FIG. 7, the center clip assembly 158 is located over center clip assembly 8 so that a clip arm 10 is placed within opening 162. Clip arm 10 is then inserted into opening 162 so that clip arm 10 slides under center clip 160 and center adapter 150 is pushed downwardly until clip arm extensions 16 contact wall 161 and the bottom of the clip arm 10 contacts wall 164. In this manner, center adapter 150 is releasably retained on center clip assembly 8.

In order to releasably remove center adapter 150 from center clip assembly 8, the medical personnel 300 can push down on center adapter 150 in order to cause clip arm extensions 16 to move away from wall 161. The medical personal can then pull up on center adapter 150 to remove the center adapter 150 from the center clip assembly 8.

Figure 8:
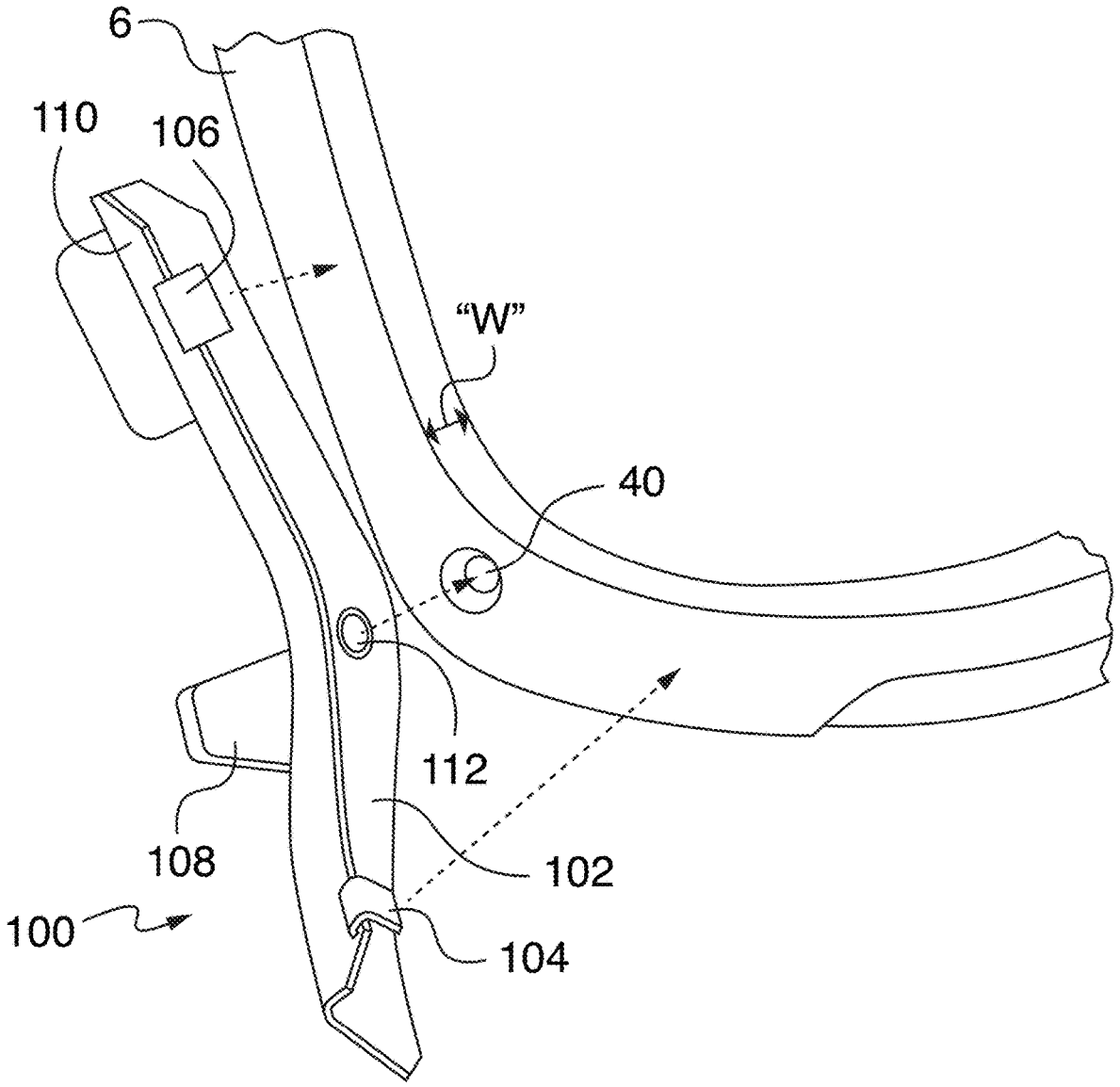
FIG. 8 is an isometric, side view illustration of an adapter system for use with a surgical helmet assembly showing a side adapter prior to being attached to the surgical helmet assembly frame, constructed according the present invention.

With respect to FIG. 8, there is illustrated another unique aspect of the present invention. In particular, as shown in FIG. 8, the helmet frame 6 is equipped with a plurality of magnets 40. It is to be understood that magnets 40 are located on both sides of the helmet frame 6 so that both side adapters 100 can be releasably attached to the helmet frame 6. Furthermore, each side adapter 100 is equipped with a magnet 112 that will interact with magnet 40 in order to assist in releasably attaching both side adapters 100 to helmet frame 6, as will be discussed in greater detail later.

A still another unique aspect of the present invention is the construction of side adapters 100 so that side adapters 100 can be quicky and easily attached to and removed from helmet frame 6. In particular, clip 104 and clip 106 are located on side adapter frame 102 so that clip 104 and clip 106 extend over a width (W) of helmet frame 6 and attach to a side of the helmet frame 6 in order to also assist in removably retaining the side adapters 100 to the helmet frame 6. For example, the side adapter 100 is located adjacent to the magnet 40 on the helmet frame 6. The magnet 112 on side adapter 100 is then located over the magnet 40. The side adapter 100 is then pushed against the helmet frame 6 so that the magnet 112 interacts with magnet 40 and the clips 104 and 106 slide over the width (W) of the helmet frame 6 and contact a side of the helmet frame 6. In this manner, side adapters 100 are securely retained on the helmet frame 6. In order to quickly and easily remove the side adapters 100 from the helmet frame 6, the side adapter 100 is lifted up by the side adapter frame 102 so that clips 104 and 106 become dislodged from the side of the helmet frame 6 and the magnet 112 becomes disconnected from the magnet 40.

Figure 9:
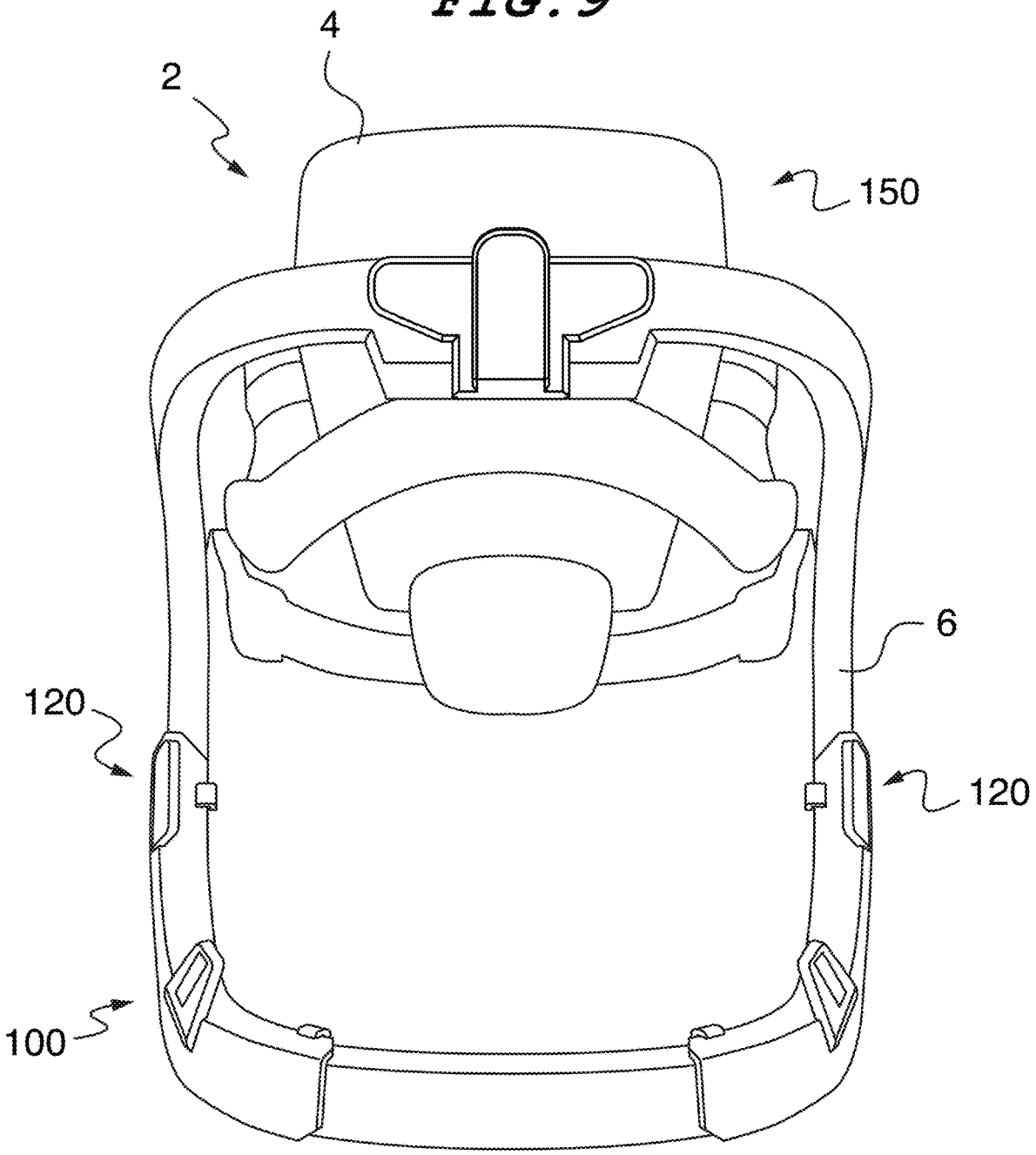
FIG. 9 is an isometric, top view illustration of the adapter system being attached to the surgical helmet assembly frame, constructed according the present invention.

With respect to FIG. 9, both side adapters 100 have been removably attached to helmet frame 6. Also, a fastener 120 such as a hook and loop (Velcro®) fastener, magnets, adhesive, or the like can be conventionally attached to the extension 108 and the extension 110. As will be discussed in greater detail later, the fastener 120 can be used in conjunction with the fastener 208 on the faceplate 204 (FIG. 10) to releasably attach the faceplate 204 of the surgical hood 200 to each side adapters 100.

Furthermore, as shown in FIG. 9, center adapter 150 has been releasably attached to center clip assembly 8 of the helmet frame 6, as discussed above. Also, extension 152 of center adapter 150 can be used in conjunction with the opening 210 on the faceplate 204 (FIG. 10) to releasably attach the faceplate 204 of the surgical hood 200 to the center adapter 150.

Operation of the Adapter Assembly 50

Regarding the operation of the adapter assembly 50, attention is directed to FIG. 10. As shown in FIG. 10, after side adapters 100 and center adapter 150 have been releasably attached to helmet frame 6, the faceplate 204 of a surgical hood 200 is releasably attached to the adapter assembly 50 through the interaction between extension 152 and opening 210 and fasteners 120 and 208, respectively. In particular, the faceplate 204 is located over the front of the helmet frame 6 so that extension 152 on the center adapter 150 lines up opening 210 on the faceplate 204 and fasteners 120 line up with fasteners 208 on faceplate 204. It is to be understood that fasteners 208 are constructed of any suitable fastener material such as a hook and loop (Velcro®) material, magnets, adhesive, or the like. Also, fasteners 208 can be conventionally attached to the back of the faceplate 204. In this manner, the surgical hood 200 having the faceplate 204 can located over the medical personnel 300 in order to protect the medical personnel 300 from direct contact with blood-borne pathogens, bone dust, fragments or the like. As discussed above, it is to be understood that center adapter 150 and the upper portion of faceplate 204 are to be located under surgical hood 200 so that the sterility of the area around the medical personnel 300 can be maintained.

Another unique aspect of the present invention is that the adapter assembly 50 can be used with any surgical hoods 200 that can be used in conjunction with a helmet 4 having a helmet frame 6. In particular, the location of the center adapter 150 with respect to opening 210 and the locations of fasteners 120 with respect to fasteners 208 allow for a quicky and easy alignment of the surgical hood 200 (and the faceplate 204) to the attachment points created on the helmet frame 6 by the adapter assembly 50 (i.e., center adapter 150 removably attaching to opening 210 and the locations of fasteners 120 removably attaching to fasteners 208). Without such an adapter assembly 50, a similar alignment of the surgical hood 200 (and the faceplate 204) to the helmet frame 6 would be time-consuming and may not result in a correct alignment between the surgical hood 200 and the helmet frame 6.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein is a new and improved system and method for removably attaching surgical hoods to surgical helmet assemblies, which according to various embodiments of the present invention, offers the following advantages: ease of use; lightness in weight; portability; ability to quickly and easily removably attach any surgical hood to a surgical helmet assembly; ability to quickly and easily remove any surgical hood from a surgical helmet assembly; reduced cost; easily attach or remove helmet adapter with no modifications to the helmet; and the ability to securely attach the surgical hood to the surgical helmet assembly. In fact, in many of the preferred embodiments, these advantages of ease of use, lightness in weight, portability, ability to quickly and easily removably attach any surgical hood to a surgical helmet assembly, ability to quickly and easily remove any surgical hood from a surgical helmet assembly, reduced cost, easily attach or remove helmet adapter with no modifications to the helmet, and the ability to securely attach the surgical hood to the surgical helmet assembly are optimized to an extent that is considerably higher than heretofore achieved in prior, known systems and methods for removably attaching surgical hoods to surgical helmet assemblies.

We claim:

1. An adapter system for use with a surgical helmet assembly and personal protective equipment (PPE) having a surgical hood, comprising:

a personal protective equipment having a surgical hood, wherein the surgical hood includes a faceplate operatively connected to the surgical hood, wherein the faceplate includes an opening located along an upper portion of the faceplate and a plurality of first fasteners located along a bottom portion of the faceplate;

a surgical helmet assembly, wherein the surgical helmet assembly is configured to support the surgical hood, and wherein the surgical helmet assembly includes a helmet frame, wherein the surgical helmet assembly is further comprised of:

a helmet operatively connected to the helmet frame;

a plurality of magnets located along a portion of the helmet frame; and a center clip assembly located on an upper portion of the helmet frame; and an adapter assembly operatively connected to the helmet frame, wherein the adapter assembly is configured to allow the faceplate of the surgical hood to be removably connected to the surgical helmet assembly, and wherein the adapter assembly is configured to align the faceplate and the surgical hood with the helmet frame.

2. The adapter system for use with a surgical helmet assembly and personal protective equipment (PPE) having a surgical hood, according to claim 1, wherein the adapter assembly is further comprised of:

a center adapter, wherein the center adapter is configured to interact with the center clip assembly to assist in retaining the faceplate on the surgical helmet assembly; and a plurality of side adapters, wherein each side adapter is configured to interact with the plurality of magnets to assist in retaining the faceplate on the surgical helmet assembly.

3. The adapter system for use with a surgical helmet assembly and personal protective equipment (PPE) having a surgical hood, according to claim 2, wherein each of the plurality of side adapters is further comprised of:

a side adapter frame;

a first side adapter clip located along one end of the side adapter frame;

a second side adapter clip located along another end of the side adapter frame;

a first side adapter extension located along the one end of the side adapter frame;

a second side adapter extension located along the another end of the side adapter frame; and a side adapter magnet located adjacent to the second side adapter extension, wherein the side adapter magnet is configured to interact with the at least one of the plurality of magnets located along the portion of the helmet frame.

4. The adapter system for use with a surgical helmet assembly and personal protective equipment (PPE) having a surgical hood, according to claim 3, wherein each of the plurality of side adapters is further comprised of:

a second fastener operatively connected to the first side adapter extension, wherein the second fastener is configured to interact with at least one of the plurality of first fasteners to assist in retaining the faceplate on the surgical helmet assembly; and a third fastener operatively connected to the second side adapter extension, wherein the third fastener is configured to interact with at least another of the plurality of first fasteners to assist in retaining the faceplate on the surgical helmet assembly.

5. The adapter system for use with a surgical helmet assembly and personal protective equipment (PPE) having a surgical hood, according to claim 2, wherein the center adapter is further comprised of:

a center adapter frame;

an extension base operatively connected to a first side of the center adapter frame;

a first extension operatively connected to the extension base, wherein the first extension is configured to interact with the opening located along an upper portion of the faceplate to assist in retaining the faceplate on the surgical helmet assembly; and a center adapter clip assembly located on a second side of the center adapter frame.

6. The adapter system for use with a surgical helmet assembly and personal protective equipment (PPE) having a surgical hood, according to claim 5, wherein the center adapter clip assembly is further comprised of:

a center clip;

a first wall located adjacent to the center clip;

a second wall located a distance away from the center clip and operatively connected to the first wall; and an opening located between the center clip, the first wall, and the second wall.

7. A method of constructing an adapter system for use with a surgical helmet assembly and personal protective equipment (PPE) having a surgical hood, comprising:

providing a personal protective equipment having a surgical hood, wherein the surgical hood includes a faceplate operatively connected to the surgical hood, wherein the faceplate includes an opening located along an upper portion of the faceplate and a plurality of first fasteners located along a bottom portion of the faceplate;

providing a surgical helmet assembly, wherein the surgical helmet assembly is configured to support the surgical hood, and wherein the surgical helmet assembly includes a helmet frame, wherein the providing a surgical helmet assembly is further comprised of the steps of:

attaching a helmet to the helmet frame;

attaching a plurality of magnets along a portion of the helmet frame; and providing a center clip assembly on an upper portion of the helmet frame; and attaching an adapter assembly to the helmet frame, wherein the adapter assembly is configured to allow the faceplate of the surgical hood to be removably connected to the surgical helmet assembly, and wherein the adapter assembly is configured to align the faceplate and the surgical hood with the helmet frame.

8. The method, according to claim 7, wherein the attaching an adapter assembly is further comprised of the steps of:

providing a center adapter, wherein the center adapter is configured to interact with the center clip assembly to assist in retaining the faceplate on the surgical helmet assembly; and providing a plurality of side adapters, wherein each side adapter is configured to interact with the plurality of magnets to assist in retaining the faceplate on the surgical helmet assembly.

9. The method, according to claim 8, wherein each of the plurality of side adapters is further comprised of:

a side adapter frame;

a first side adapter clip located along one end of the side adapter frame;

a second side adapter clip located along another end of the side adapter frame;

a first side adapter extension located along the one end of the side adapter frame;

a second side adapter extension located along the another end of the side adapter frame; and a side adapter magnet located adjacent to the second side adapter extension, wherein the side adapter magnet is configured to interact with the at least one of the plurality of magnets located along the portion of the helmet frame.

10. The method, according to claim 9, wherein each of the plurality of side adapters is further comprised of:

a second fastener operatively connected to the first side adapter extension, wherein the second fastener is configured to interact with at least one of the plurality of first fasteners to assist in retaining the faceplate on the surgical helmet assembly; and a third fastener operatively connected to the second side adapter extension, wherein the third fastener is configured to interact with at least another of the plurality of first fasteners to assist in retaining the faceplate on the surgical helmet assembly.

11. The method, according to claim 8, wherein the providing a center adapter is further comprised of the steps of:

providing a center adapter frame;

attaching an extension base to a first side of the center adapter frame;

attaching a first extension to the extension base, wherein the first extension is configured to interact with the opening located along an upper portion of the faceplate to assist in retaining the faceplate on the surgical helmet assembly; and providing a center adapter clip assembly on a second side of the center adapter frame.

12. The method, according to claim 11, wherein the providing a center adapter clip assembly is further comprised of the steps of:

providing a center clip;

providing a first wall adjacent to the center clip;

providing a second wall a distance away from the center clip and operatively connected to the first wall; and providing an opening between the center clip, the first wall, and the second wall.

13. A method of using an adapter system for use with a surgical helmet assembly and personal protective equipment (PPE) having a surgical hood, comprising:

providing a personal protective equipment having a surgical hood, wherein the surgical hood includes a faceplate operatively connected to the surgical hood, wherein the faceplate includes an opening located along an upper portion of the faceplate and a plurality of first fasteners located along a bottom portion of the faceplate;

providing a surgical helmet assembly, wherein the surgical helmet assembly is configured to support the surgical hood, and wherein the surgical helmet assembly includes a helmet frame, wherein the providing a surgical helmet assembly is further comprised of the steps of:

attaching a helmet to the helmet frame;

attaching a plurality of magnets along a portion of the helmet frame; and providing a center clip assembly on an upper portion of the helmet frame; and attaching an adapter assembly to the helmet frame, wherein the adapter assembly is configured to allow the faceplate of the surgical hood to be removably connected to the surgical helmet assembly, and wherein the adapter assembly is configured to align the faceplate and the surgical hood with the helmet frame.

14. The method, according to claim 13, wherein the attaching an adapter assembly is further comprised of the steps of:

providing a center adapter, wherein the center adapter is configured to interact with the center clip assembly to assist in retaining the faceplate on the surgical helmet assembly; and providing a plurality of side adapters, wherein each side adapter is configured to interact with the plurality of magnets to assist in retaining the faceplate on the surgical helmet assembly.

15. The method, according to claim 14, wherein each of the plurality of side adapters is further comprised of:

a side adapter frame;

a first side adapter clip located along one end of the side adapter frame;

a second side adapter clip located along another end of the side adapter frame;

a first side adapter extension located along the one end of the side adapter frame;

a second fastener operatively connected to the first side adapter extension, wherein the second fastener is configured to interact with at least one of the plurality of first fasteners to assist in retaining the faceplate on the surgical helmet assembly;

a second side adapter extension located along the another end of the side adapter frame;

a third fastener operatively connected to the second side adapter extension, wherein the third fastener is configured to interact with at least another of the plurality of first fasteners to assist in retaining the faceplate on the surgical helmet assembly; and a side adapter magnet located adjacent to the second side adapter extension, wherein the side adapter magnet is configured to interact with the at least one of the plurality of magnets located along the portion of the helmet frame.

16. The method, according to claim 14, wherein the providing a center adapter is further comprised of the steps of:

providing a center adapter frame;

attaching an extension base to a first side of the center adapter frame;

attaching a first extension to the extension base, wherein the first extension is configured to interact with the opening located along an upper portion of the faceplate to assist in retaining the faceplate on the surgical helmet assembly; and providing a center adapter clip assembly on a second side of the center adapter frame.

17. The method, according to claim 16, wherein the providing a center adapter clip assembly is further comprised of the steps of:

providing a center clip;

providing a first wall adjacent to the center clip;

providing a second wall a distance away from the center clip and operatively connected to the first wall; and providing an opening between the center clip, the first wall, and the second wall.

* * * * *